US005441442A

United States Patent [19]

Haisma et al.

[11] Patent Number: 5,441,442

[45] Date of Patent: Aug. 15, 1995

[54] METHOD OF MANUFACTURING A PLATE HAVING A PLANE MAIN SURFACE, METHOD OF MANUFACTURING A PLATE HAVING PARALLEL MAIN SURFACES, AND DEVICE SUITABLE FOR IMPLEMENTING SAID METHODS

[75] Inventors: Jan Haisma; Peter W. De Haas; Franciscus J. H. M. Van Der Kruis; Jakob Vijfvinkel, all of Eindhoven, Netherlands

[73] Assignee: U.S. Philips Corporation, New York, N.Y.

[21] Appl. No.: 71,908

[22] Filed: Jun. 3, 1993

[30] Foreign Application Priority Data

Jun. 5, 1992 [EP] European Pat. Off. ..... 92201739

[51] Int. Cl.[6] ..... B24B 7/04; B24B 7/22

[52] U.S. Cl. ..... 451/63; 451/41; 451/288; 451/400

[58] Field of Search ..... 51/131.2, 131.3, 131.4, 51/131.5, 133, 283 R, 284 R, 363, 373, 117, 118, 372, 376; 451/264, 274, 63, 398, 400, 259, 548

[56] References Cited

U.S. PATENT DOCUMENTS

| | | | |
|---|---|---|---|
| 3,924,361 | 12/1975 | White et al. . | |
| 4,313,284 | 2/1982 | Walsh . | |
| 4,593,495 | 6/1986 | Kawakami | 51/131.2 |
| 4,606,151 | 8/1986 | Heynacher | 51/283 R |
| 4,831,789 | 5/1989 | Herbin | 51/363 |
| 4,940,507 | 7/1990 | Harbarger | 156/636 |
| 5,255,474 | 10/1993 | Gawa | 51/284 R |

FOREIGN PATENT DOCUMENTS 2232085 12/1974 France .

*Primary Examiner*—Jack W. Lavinder
*Attorney, Agent, or Firm*—Michael J. Balconi-Lamica

[57] ABSTRACT

Methods and device for manufacturing a plate with a plane main surface or with parallel main surfaces, whereby material is taken off from the edges of the plate and from the central portion of the plate alternately by means of polishing in order to obtain main surfaces having a convex, plane, or concave shape. Polishing is stopped after at least one transition from convex to concave or vice versa at the moment at which the main surface has a substantially plane shape or has substantially parallel main surfaces.

30 Claims, 6 Drawing Sheets

R = ∞

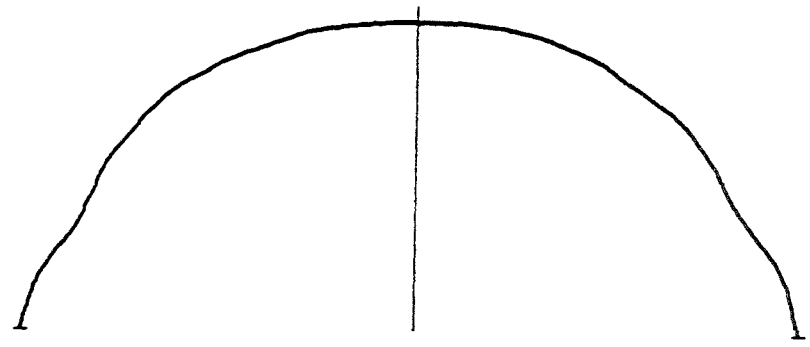
FIG. 5a
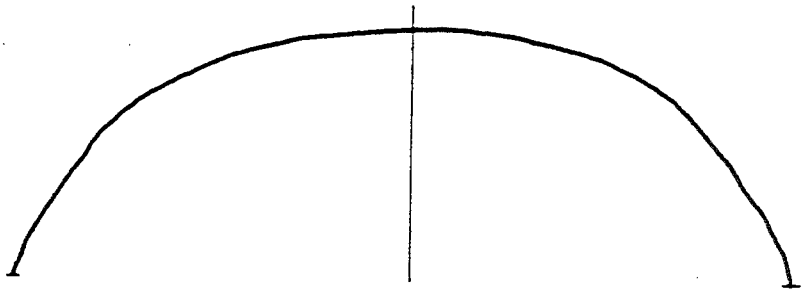
FIG. 5b
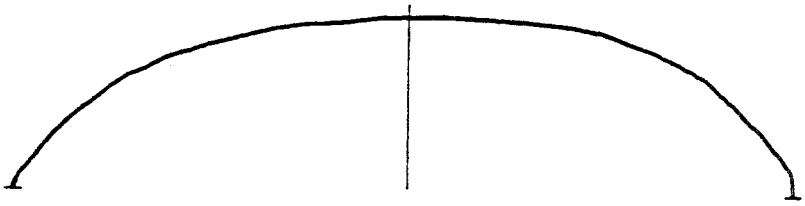
FIG. 5c
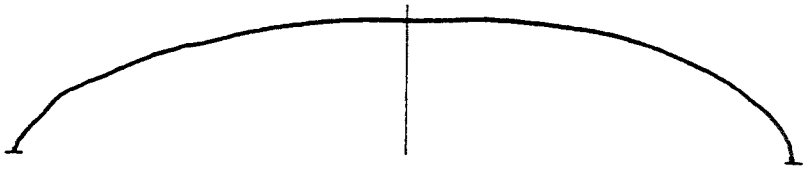
FIG. 5d
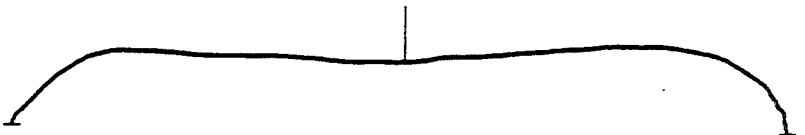
FIG. 5e
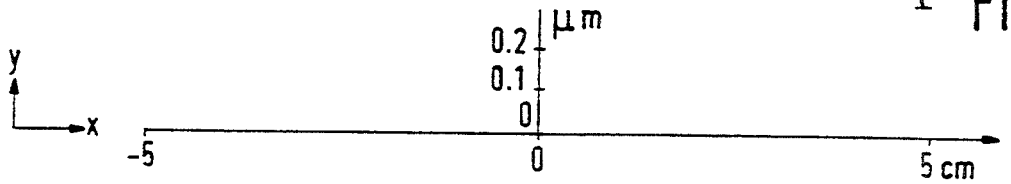

METHOD OF MANUFACTURING A PLATE HAVING A PLANE MAIN SURFACE, METHOD OF MANUFACTURING A PLATE HAVING PARALLEL MAIN SURFACES, AND DEVICE SUITABLE FOR IMPLEMENTING SAID METHODS

Method of manufacturing a plate having a plane main surface, method of manufacturing a plate having parallel main surfaces, and device suitable for implementing said methods.

BACKGROUND OF THE INVENTION

The invention relates to a method of manufacturing a plate having a plane main surface through polishing of the main surface of the plate.

The invention also relates to a method of manufacturing a plate having parallel main surfaces through simultaneous polishing of the two main surfaces.

The invention further relates to a device suitable for implementing the methods according to the invention.

In the present Patent document, the term "polishing" is used as a blanket term for precision machining techniques such as grinding, polishing, and lapping which are suitable for manufacturing a plate with an accurately machined surface and whereby a bulk-reduction treatment is carried out at the surface of the plate by means of a machining agent and a polishing surface. The term "polishing surface" in the present Patent document designates the surface by means of which a main surface of a plate is polished.

Methods and a device suitable for polishing plates are known from U.S. Pat. No. US-A-4940507 and are used inter alia for polishing comparatively thin plates such as, for example, silicon or glass slices. The plate is brought between two polishing surfaces in the known device. Polishing agent is introduced between the polishing surface and the plate through openings in the polishing surface, and material is removed from the plate through the displacement of the plate relative to the polishing surfaces. In the known device, the result of the polishing process is dependent on the positions and the shape of the openings in the polishing surface. The accuracy as regards planeness and parallelity of the main surfaces which can be achieved by the known methods and device, however, are limited.

SUMMARY OF THE INVENTION

The invention has for its object to provide a method by which the planeness of a main surface of a plate is enhanced.

The method according to the invention achieves this object in that first the main surface of the plate is prepared through polishing until the main surface has a convex or concave initial shape, and in that subsequently at least once a bulk-reduction cycle is performed during which, if the initial shape is concave, the main surface is so polished that the main surface is given consecutively a substantially plane shape, a convex shape, and again a substantially plane shape, and, in the case of a convex initial shape, the main surface is so polished that the main surface is given consecutively a substantially plane shape, a concave shape, and again a substantially plane shape.

During polishing of a convex surface into a concave surface or vice versa, the main surface of the plate has a substantially plane shape at a certain moment. Polishing may be stopped at that certain moment. It is found, however, that the deviation of the main surface from an exact plane shape is reduced when the main surface is polished further until it has a concave shape and subsequently the main surface is polished so that it will have a convex shape again. In this process, the main surface will have a substantially exact plane shape at a certain moment. The deviation from an exact plane shape is smaller now than in the previous plane shapes. The more often the shape of the main surface is changed from convex to concave, the smaller the deviation from exact planeness of the plane shape will be at the moment of transition from a convex to a concave shape, or vice versa.

The invention also has for its object to provide a method by which the parallelity of the main surfaces of a plate is increased. The method according to the invention achieves this object in that first the main surfaces of a plate are prepared through polishing until these main surfaces have a convex, plane, or concave initial shape, and in that subsequently at least once a bulk-reduction cycle is performed during which, in the case of a plate having edges which are thicker than a central portion surrounded by the edges, the main surfaces are so polished that the edges are subsequently given a substantially equal thickness, a smaller thickness, and again a substantially equal thickness as compared with the central portion, and in the case of a plate having edges which are thinner than a central portion surrounded by the edges, the main surfaces are so polished that the edges are given consecutively a substantially equal thickness, a greater thickness, and again a substantially equal thickness as compared with the central portion.

The method is suitable for manufacturing a plate having main surfaces which are both plane, or for manufacturing a comparatively thin plate having main surfaces which both have the same curvature, so that the said surfaces are parallel.

With comparatively thin plates (thickness up to approximately 2 mm), the elastic deformability of the plate means that the planeness of a main surface is difficult to define, but the parallelity of the main surfaces is unequivocally determined. If a thin plate has one convex and one concave main surface, both having the same curvature, a plate having perfectly plane main surfaces is thus obtained under elastic deformation of the plate in that the curved plate is fastened on a comparatively thick support block having a plane surface.

According to the method according to the invention, a curved main surface is so polished that it is given consecutively a radius of curvature which is smaller than desired, which is as desired, and which is greater than desired, and the bulk-reduction cycle is stopped the moment the main surface has the desired radius of curvature. The more often the bulk-reduction cycle is repeated, the smaller the deviation from the ideal curvature over the total dimension of the main surface will be.

In both methods according to the invention, material is removed alternately from the edges of the plate and from the central portion of the plate so as to obtain main surfaces having a convex, plane, or concave shape.

The embodiments of the methods according to the invention relate to various methods of polishing the main surfaces by which a desired reduction can be realised.

An embodiment of the methods according to the invention is characterized in that the shape of the polishing surface is changed during the bulk-reduction cycle so as to obtain a greater or smaller bulk reduction at the edges than in the central portion of the main surface. The shape of the polishing surface may be varied between convex, plane, and concave, or between shapes having a radius of curvature smaller than, equal to, and greater than the desired radius, depending on whether the desired final shape of the plate is plane or curved.

Another embodiment of the methods according to the invention is characterized in that the relative speed of the polishing surface relative to the main surface of the plate is so changed during the bulk-reduction cycle that a greater or smaller reduction is obtained at the edges of the main surface than in the central portion.

Experiments have shown that the shape of the main surface can be changed through the change in relative speed.

A further embodiment of the methods according to the invention is characterized in that the force with which the polishing surface is pressed against the plate during the bulk-reduction cycle is varied, whereby a greater reduction at the edges than in the central portion is obtained at a comparatively low force and a smaller reduction at the edges than in the central portion is obtained at a comparatively high force.

Experiments have shown that the plate surface can be converted from convex to concave by raising the compression force during polishing, and from concave to convex by lowering the compression force. The explanation of this effect is probably the following. When the compression force is small, a comparatively strong renewal of the polishing liquid takes place especially at the edges of the plate. The reduction at the edges as a result is greater than in the central portion. The plate surface then becomes convex. When the compression force is subsequently raised, the greatest reduction will take place in the central portion because the pressure on the plate surface is highest there. The plate then becomes concave.

The invention also has for its object to provide a device which is fitted with at least one polishing surface, which is suitable for carrying out the methods, and by which the disadvantage of the known device is avoided. This object is achieved in the device according to the invention in that the shape of the polishing surface is deformable.

The plate surface will be given a concave, plane or convex shape during polishing in that the polishing surface is provided with a shape of varying radial curvature.

An embodiment of a device suitable for carrying out the methods according to the invention is characterized in that the device is provided with a carrier which comprises the polishing surface and which is hinged to a holder, while a pressure can be applied between the carrier and the holder by which the carrier is deformed. The shape of the polishing surface can be changed by varying the pressure between the carder and the holder by means of a liquid or a gas.

BRIEF DESCRIPTION OF THE DRAWINGS

The invention is explained in more detail with reference to the drawing in which FIG. 1 diagrammatically shows a present-art device, FIG. 1*a* being a cross-section and FIG. 1*b* a plan view, FIG. 5 shows the measured deviations from a plane surface during a number of phases in the bulk-reduction cycle of the method according to the invention, FIG. 6*a–g* diagrammatically shows a second plate during a number of phases of the bulk-reduction cycle of the method according to the invention.

Corresponding components are given the same reference numerals in the various Figures.

DETAILED DESCRIPTION OF THE PREFERRED EMBODIMENT

Figure 1A:
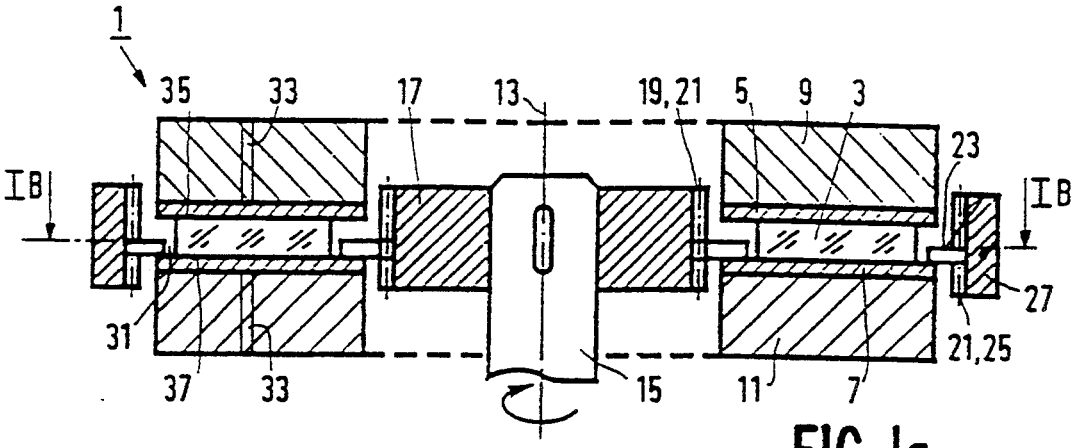
FIG. 1a PRIOR ART
Figure 1B:
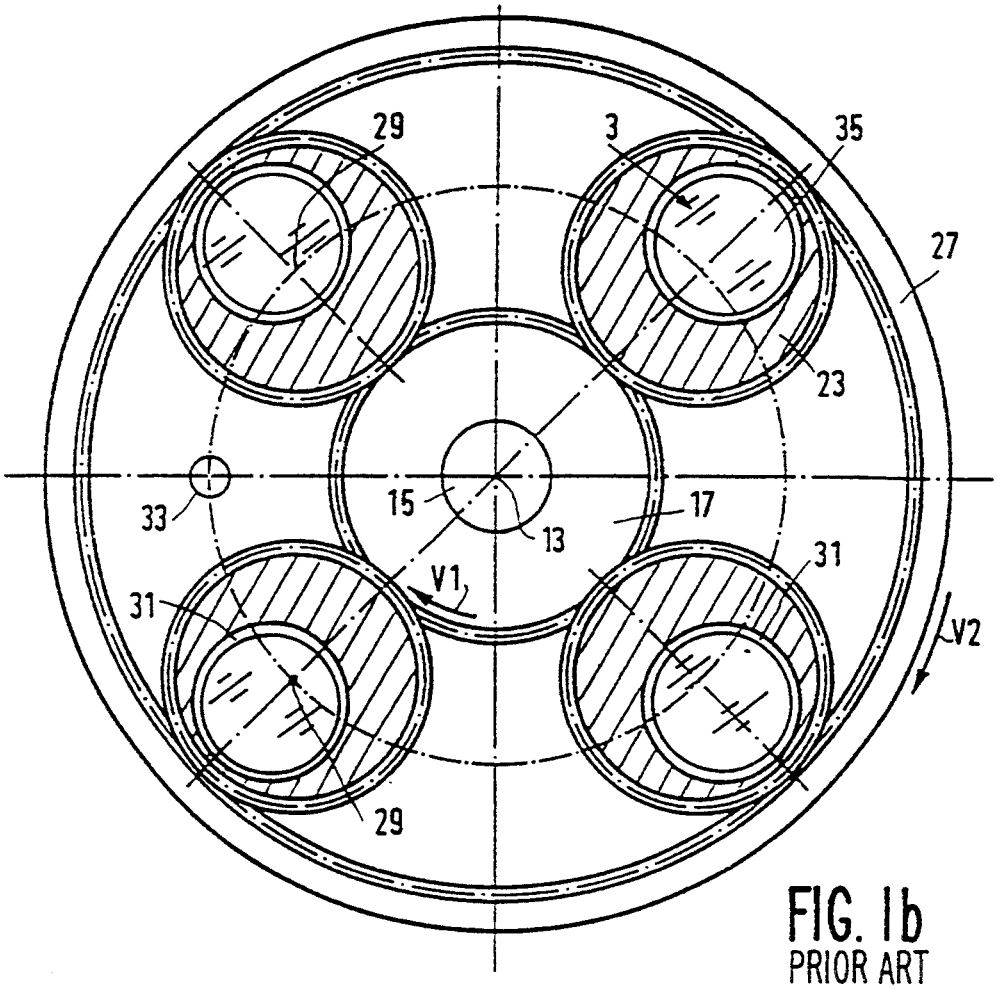
FIG. 1b PRIOR ART

FIG. 1 shows a present-art device 1 known from US-A-4940507. The known device 1 is suitable for double-sided polishing of plates 3 by means of polishing surfaces 5, 7 fastened on holders 9, 11. The device 1 is provided with a pin 15 which can rotate about a central shaft 13 and to which a disc 17 is fastened. The disc 17 is provided with circumferential teeth 19 which are in engagement with teeth 21 of annular elements 23, called rotors. The teeth of the rotors 23 are also in engagement with teeth 25 of a ring 27 which can rotate about the central shaft 13. The ring 27 and the disc 17 can rotate independently of one another by means of separate drive mechanisms (not shown), so that each rotor 23 performs a rotation about the shaft 29 of the rotor 23 and/or a rotation about the central shaft 13, depending on the circumferential speeds V1, V2 and the directions of rotation of the disc 17 and the ring 27. Each rotor 23 is provided with at least one opening 31 in which a plate 3 to be polished is deposited.

The operation of the device will be briefly explained. The holder 9 with the polishing surface 5 is removed, so that the plates 3 to be polished can be laid in the openings 31 of the rotors 23. The diameter of the plates 3 is smaller than the diameter of the openings 31, the thickness of the plates 3 to be polished is greater than the thickness of the rotors 23. Then the holder 9 is laid with the polishing surface 5 on the plates 3. A polishing agent is supplied to the main surfaces 35, 37 of the plates 3 through openings 33 in the holders 9, 11, after which the disc 17 and the ring 27 are rotated by the drive mechanisms and the rotors 23 are displaced. The plates 3 present in the rotors are taken along by the rims of the openings 31 in the rotors 23 and are displaced relative to the polishing surfaces which have a fixed position. The relative displacement between the stationary polishing surfaces 5, 7 and the main surfaces of the plates 3 creates friction between these surfaces. The friction between the main surfaces 35, 37 of the plates 3 and the polishing surfaces 5, 7 also causes the plates 3 to carry out a displacement relative to the rotors 23, so that the total movement performed by the plate 3 depends on the movement of the rotor 23 and on the friction. Material is removed from the plates 3 tribochemically owing to the friction and the chemical action of the polishing agent present between the surfaces.

Figure 2:
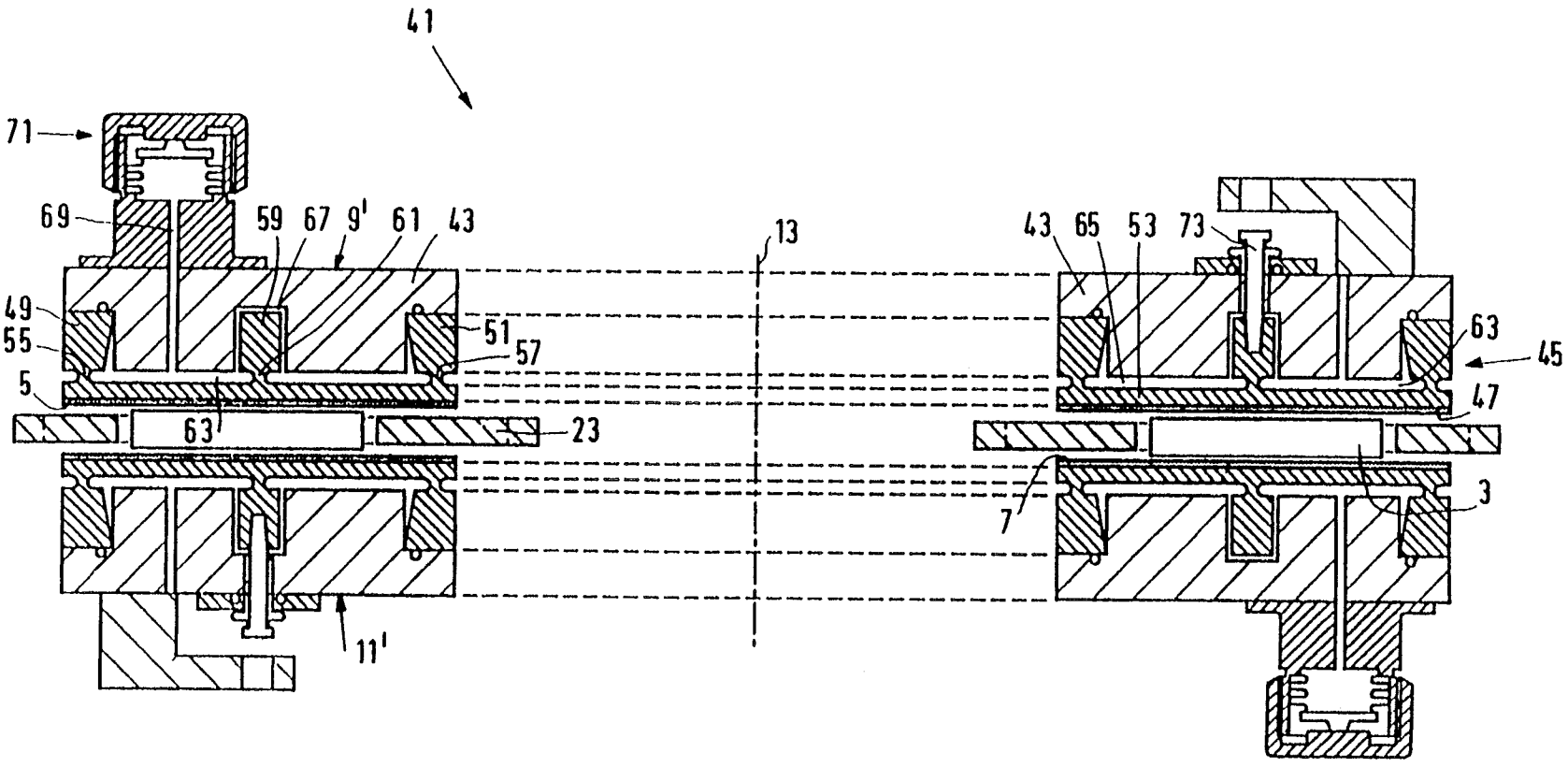
FIG. 2 is a diagrammatic cross-section of a device according to the invention, FIG. 3 diagrammatically shows an alternative embodiment of a device according to the invention, FIG. 3*a* being a cross-section and FIG. 3*b* a plan view, FIG. 4*a–g* diagrammatically shows a first plate during a number of phases in the bulk-reduction cycle of the method according to the invention.

FIG. 2 is a diagrammatic cross-section of a device 41 according to the invention which is provided, as is the device 1, with a rotatable disc 17 and a rotatable ring 27, by means of which rotors 23 and the plates 3 present therein can be rotated. The device 41 is provided with holders 9', 11'. The holder 9' and the holder 11' are identical and their construction and operation will be explained with reference to the holder 9'. The holder 9' is provided with a frame 43 and an annular carrier 45 fastened thereto, on which carrier a polishing cloth 47 with the polishing surface 5 is glued. The carrier 45 is provided with two support rings 49, 51 by which the carder 45 is fastened to the support rings 49, 51. The carder 45 is further provided with an annular carrier plate 53 which is connected to the frame 43 via two annular elastic hinges 55, 57. The carrier plate 53 is provided with an auxiliary ring 59 which is connected to the carrier plate via an annular elastic hinge 61. A chamber 63 and a chamber 65 interconnected by a channel 67 are present between the carrier plate 53 and the frame 43. The chamber 63 is in connection with a pressure governor 71, which is known per se, through a channel 69. The carrier plate 53 is deformed in that an oil or gas pressure is applied to the chamber 63 and through the channel 67 to the chamber 65 by means of the pressure governor 71. The carder plate 53 can bend over its full width as a result of the annular elastic hinges 55, 57. The auxiliary ring 59 is displaced during this in a direction away from the frame 43. To measure this displacement, the device 41 is provided with a measuring probe 73 which is fastened in an opening in the auxiliary ring 59. The displacement of the measuring probe 73 can be determined by means of a micrometer (not shown).

The carrier plate 53 is deformed in a direction towards the frame 43 in that an underpressure is applied to the chambers 63, 65 by means of the pressure governor 71.

Figure 3A:
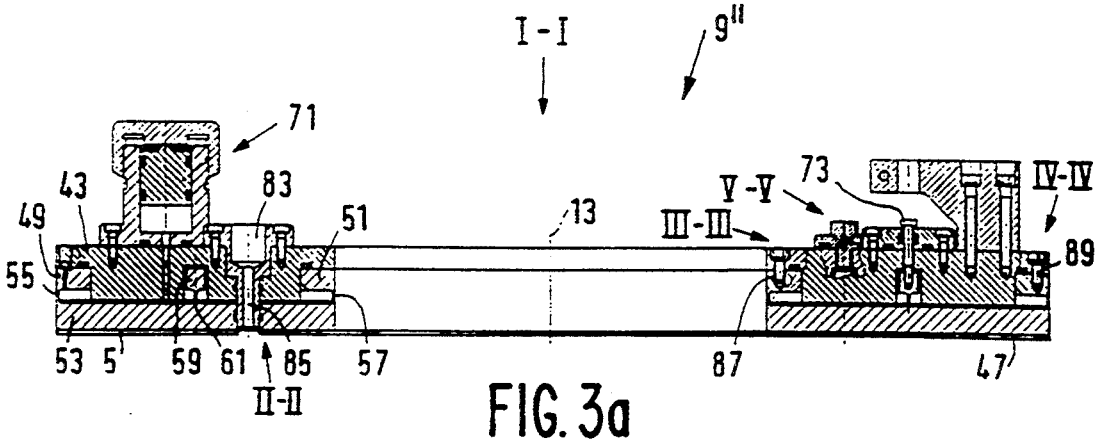
Figure 3B:
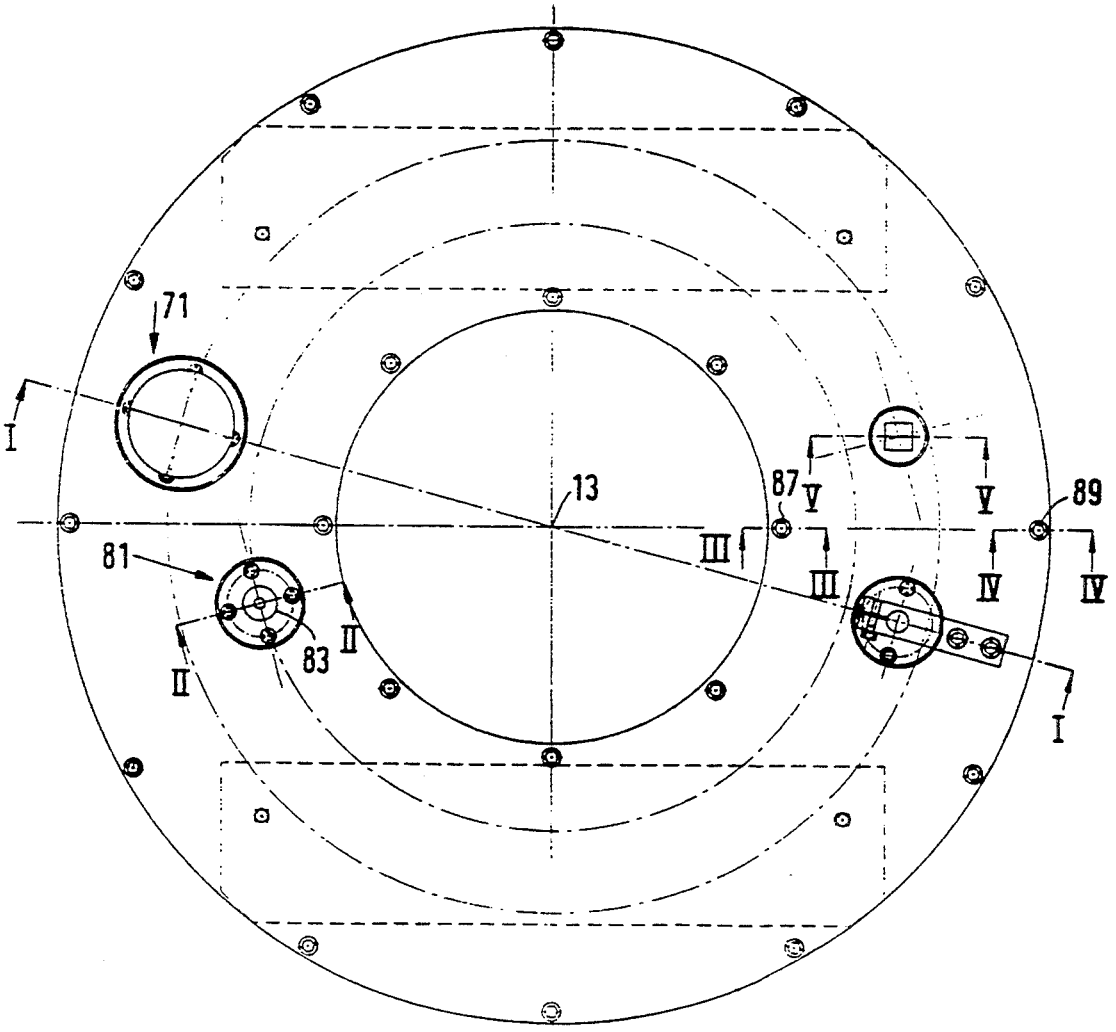
Figure 4A:
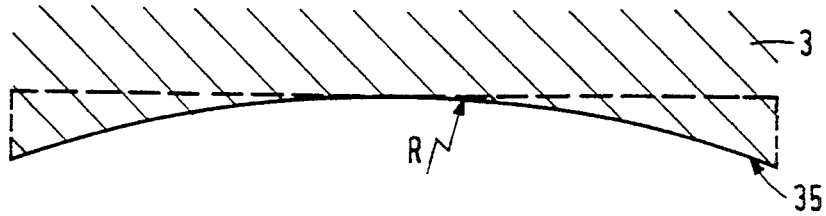
Figure 4B:
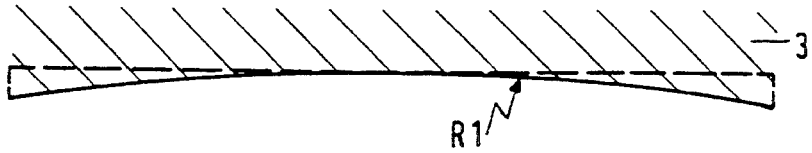
Figure 4C:
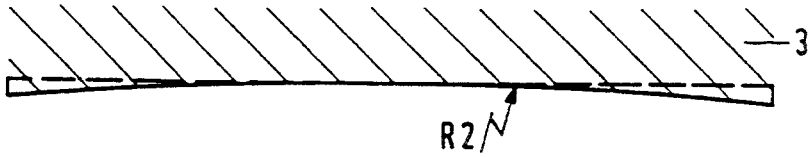
Figure 4D:
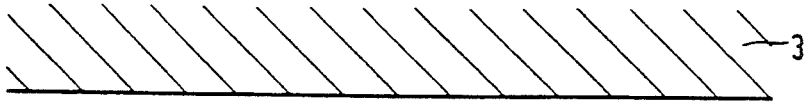
Figure 4E:
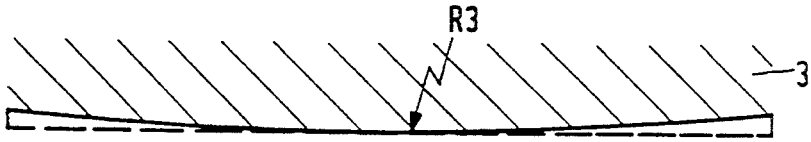
Figure 4F:
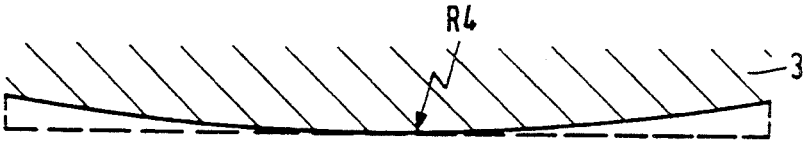
Figure 4G:
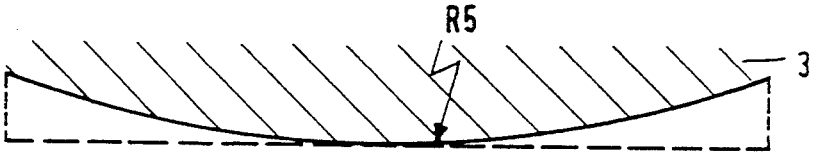
Figure 6A:
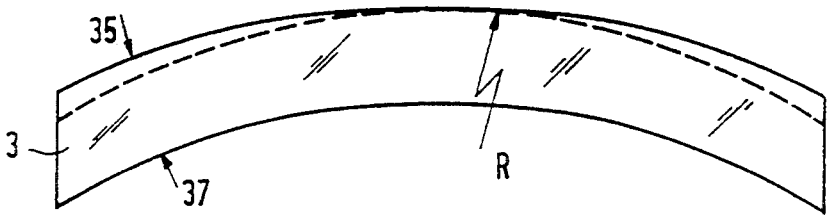
Figure 6B:
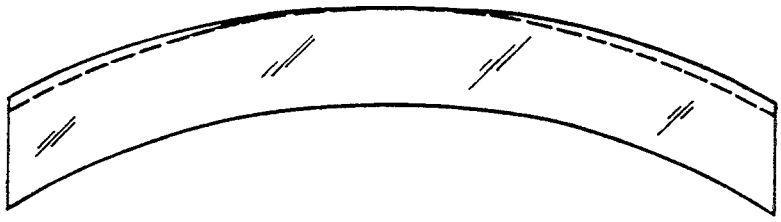
Figure 6C:
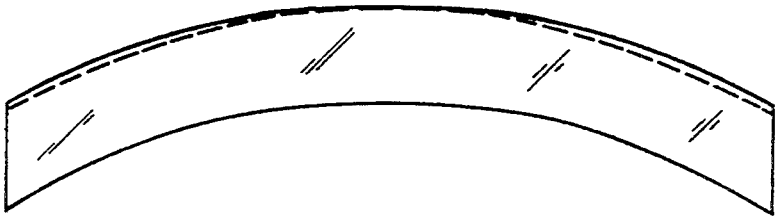
Figure 6D:
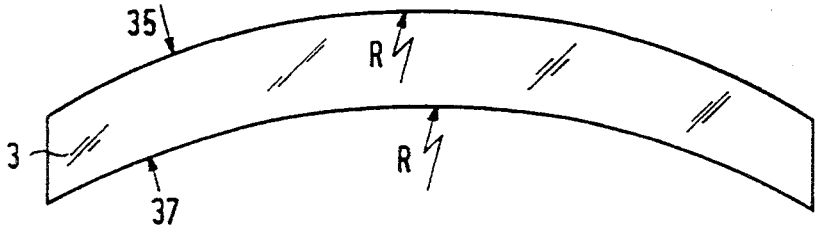
Figure 6E:
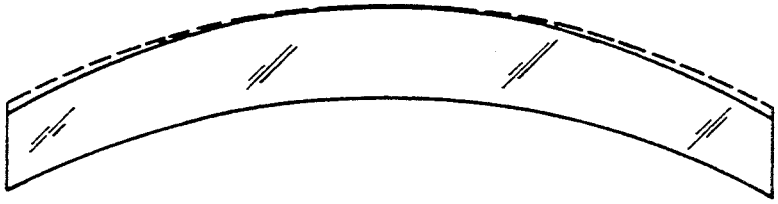
Figure 6F:
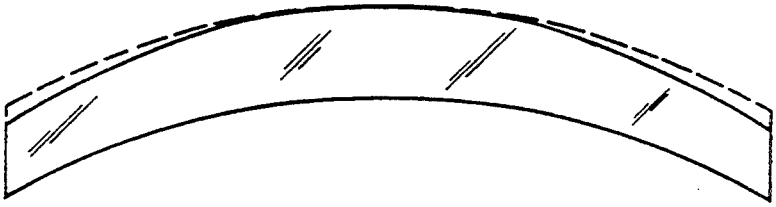
Figure 6G:
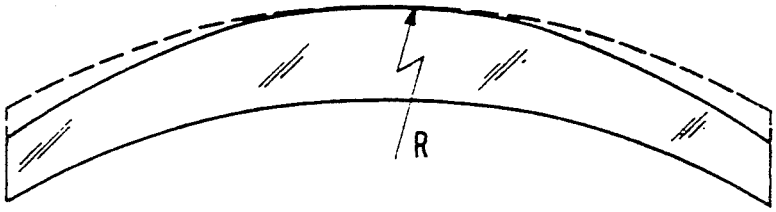

FIG. 3 diagrammatically shows an alternative embodiment of a holder 9" according to the invention, FIG. 3*a* being a cross-section and FIG. 3*b* a plan view of the holder 9". To limit the number of Figures, all cross-sections indicated in FIG. 3*b* are shown in FIG. 3*a*.

The cross-section I—I shows a pressure governor 71 which corresponds to the pressure governor shown in FIG. 2 and the measuring probe 73. A curvature of the carrier plate 53 towards the frame 43 and away from the frame 43 can be obtained by means of the pressure governor 71, whereby the measuring probe 73 is displaced over, for example, 10 μm for a width of the annular carrier plate 53 in radial direction of, for example, 105 mm.

The cross-section II—II shows a feed device 81 for polishing agent, provided with an opening 83 and a channel 85 issuing therein and running through the polishing surface 5, so that polishing agent can be brought between the plate 3 and the polishing surface.

The cross-sections III—III and IV—IV show bolts 87 and 89 with which the support rings 49, 51 are connected to the frame 43.

The cross-section V—V shows a vent hole.

The method according to the invention will now be briefly explained with reference to FIGS. 4, 5 and 6.

FIG. 4 diagrammatically shows the principle of the method according to the invention. Before the start of the precision operation, the plate 3 is provided with a curvature having a radius of curvature R by machining methods known per se, as used in glass and silicon technology. The exact value of R is of minor importance, as long as the initial shape of the plate 3 is convex or concave. The deviation from an exact plane shape before the precision operation is approximately 5 μm over a diameter of 10 cm. Starting from the situation shown in FIG. 4*a*, where the initial surface of the plate 3 is concave, the plate surface 35 is subsequently polished in such a way that it is given an ever increasing radius of curvature (with $R<R1<R2$) until the radius of curvature is infinite, after which the plate surface 35 is so polished that the surface 35 becomes convex, the radius of curvature being reduced ($R3>R4>R5$). The moment an absolute deviation from an exact plane shape of approximately 0,1 μm is measured, the polishing process is reversed and the plate surface 35 is so polished that it assumes shapes consecutively as shown in FIG. 4*g*, 4*f*, 4*e*, 4*d*, 4*c*, 4*b*, 4*a*, 4*b*, 4*c*, 4*d*. Each time the plate surface has reached the shape diagrammatically shown in FIG. 4*d*, a greater surface area of the plate approximates the perfectly plane shape.

A quartz glass plate having a diameter of 10 cm and a thickness of 3 mm was polished in this manner, the plate surface having a deviation of 5 μm from a geometrically defined plane surface before polishing, and a deviation of 0,02 μm after polishing. The plate surface was polished from convex to concave and vice versa three times during this. The transition from a convex to a concave shape took approximately 0 minutes. Polishing was stopped regularly in order to inspect the achieved curvature of the main surface. Polishing from a convex to a concave form was switched to polishing from a concave to a convex form the moment the main surface had a deviation of 0,1 μm relative to a perfectly plane shape.

Polishing of a plate surface from convex to concave and vice versa may be realised in a number of ways.

A first method is to vary the compression force with which the polishing surfaces 5, 7 are pressed against the main surfaces 35, 37. The compression force may be varied in that annular weights are deposited on the holder 9 (FIG. 1 ) depending on the desired compression force, or in that the holder 9 is pressed against the holder 11 with an adjustable hydraulic force.

Experiments have shown that the plate surface can be changed from convex to concave in that the compression force during polishing is increased, and from concave to convex in that the compression force is reduced. The explanation of this effect is probably the following. When the compression force is small, a comparatively strong renewal of the tribochemical polishing liquid takes place especially at the edges of the plate. The reduction at the edges is greater than in the central portion owing to the chemical action. The plate surface then becomes convex. When the compression force is increased again, the greatest reduction will take place on the central portion because the pressure on the plate surface is highest there. Owing to the increased pressure, mechanical polishing prevails, and this probably takes place most strongly in the centre. The plate then becomes concave.

This method was applied with a single-sided polishing machine in which a silicon slice was fastened on a fixedly arranged support block and a polishing surface was moved over the silicon slice. The convex-concave transition and vice versa was completed several times until a planeness was obtained with a deviation of less than 0,05 μm over a slice surface of 9,5 cm diameter.

A second method of polishing a plate surface from convex to concave and vice versa on a double-sided polishing machine is to vary the rotation speeds of the disc 17 and the ring 27 (FIG. 1). Experiments have shown that an increase in the rotation speed V1 of the disc 17 at a constant rotation speed V2 of the ring 27 renders the plate surface concave, whereas a reduction in the rotation speed V1 renders the plate surface convex.

Such experiments were carried out on quartz slices having a diameter of 10 cm and a thickness of 3 mm, which had an absolute deviation of approximately 0,5 μm from parallelity relative to two perfectly parallel plates, the centre being thicker than the edges at the start of the polishing treatment. The deviation from parallelity was reduced to 0,1 μm over a surface having a diameter of 9 cm by the method described above. The rotation speed V2 was kept constant and the rotation speed V1 was varied, the highest speed V1 being three times the lowest speed V1.

A third method of polishing a plate surface from convex to concave and vice versa is to vary a shape of the polishing surface 5, 7 (FIGS. 2 and 3). The carrier plate 53 and the polishing surface 5 are deformed through the application of a liquid or gas pressure to the chambers 63 and 65 by means of the pressure governor 71. The polishing surface 7 is deformed in an identical manner. The shape of the polishing surface 5, 7 is thus changed according to a toroid, i.e. each cross-section in radial direction of the annular polishing surface is convex or concave.

FIG. 5 shows test results of polishing of a silicon slice of 3 mm thickness and 10 cm diameter. The pressure on the plate surface was 7,5 g/cm$^2$. The shape of the polishing surface was adapted every two hours. The position on the slice is plotted on the x-axis and the absolute deviation from a plane surface in μm on the y-axis. FIG. 5*a* shows the initial position. FIGS. 5*b*, 5*c*, 5*d* and 5*e* show consecutive test results, the sagging of the polishing surface measured by the measuring probe 73 being 3, 5, 7 and 9 μm, respectively.

FIG. 6 diagrammatically shows the various shapes which a comparatively thin plate 3 assumes during various phases in the bulk-reduction cycle, the initial shape of the plate 3 being curved. It is difficult to ascertain whether the surface of such a plate 3 is plane because the plate is elastically deformable. It is more important for a comparatively thin plate that the main surfaces 35, 37 are parallel. The plate will then have plane main surfaces the moment the plate is fastened on a comparatively thick carrier with a plane main surface seamlessly and without glue by means of wringing, van der Waals bonding or direct bonding. In FIGS. 6*a* to 6*g*, the radius of curvature R of the main surface 35 of the plate 3 is reduced. In FIG. 6*d*, the radius of curvature of the main surface 35 is equal to that of the main surface 37, and the plate 3 depicted in this Figure will also have plane main surfaces when fastened on a plane surface under elastic deformation of the plate 3.

The plates in the examples were always circular, but the plates may alternatively have different shapes such as, for example, square. To render rotation of square plates in the rotors possible, an auxiliary rotor may be used which is laid in the opening of the rotor and which is provided with a circular outer rim and a square inner rim for accommodating the plate.

It is possible to combine the various methods of polishing a plate surface from convex to concave and vice versa in order to obtain, for example, a more convex or concave shape than is possible when only one method is used. The speed variation in the rotation speeds V1 and V2 is limited by the maximum admissible rotation speeds of the device, so that also the achievable curvature of the plates is limited. By combining speed variation with compression force variation, the achievable curvature of the main surface can be increased.

We claim:

1. A method of manufacturing a plate having a planar main surface through polishing of the main surface of the plate comprising:

polishing the main surface of the plate until the main surface has a concave initial shape, and performing a bulk-reduction cycle which comprises polishing the concave initial shape so that the main surface is given consecutively a substantially planar shape, a convex shape and again a substantially planar shape.

2. A method as claimed in claim 1 in which polishing is carried out by means of a polishing surface, wherein the shape of the polishing surface is changed during the bulk-reduction cycle so as to obtain a greater or smaller bulk reduction at the edges than in the central portion of the main surface.

3. A method as claimed in claim 1, in which polishing is carried out by means of a polishing surface, wherein the relative speed of the polishing surface relative to the main surface of the plate is so changed during the bulk-reduction cycle that a greater or smaller reduction is obtained at the edges of the main surface than in the central portion.

4. A method as claimed in claim 1, in which polishing is carried out by means of a polishing surface, wherein the force with which the polishing surface is pressed against the plate during the bulk-reduction cycle is varied, whereby a greater reduction at the edges than in the central portion is obtained at a comparatively low force and a smaller reduction at the edges than in the central portion is obtained at a comparatively high force.

5. A method of manufacturing a plate having parallel main surfaces through simultaneous polishing of the two main surfaces comprising:

polishing the main surfaces of a plate until these main surfaces have a convex, initial shape, and performing a bulk-reduction cycle during which, in the case of a plate having edges which are thicker than a central portion surrounded by edges, the main surfaces are so polished that the edges are subsequently given a substantially equal thickness, a smaller thickness, and again a substantially equal thickness as compared with the central portion, and in the case of a plate having edges which are thinner than a central portion surrounded by edges, the main surfaces are so polished that the edges are given consecutively a substantially equal thickness, a thicker thickness, and again a substantially equal thickness as compared with the central portion.

6. A method as claimed in claim 5, in which polishing is carried out by means of a polishing surface, wherein the shape of the polishing surface is changed during the bulk-reduction cycle so as to obtain a greater or smaller bulk reduction at the edges than in the central portion of the main surface.

7. A method as claimed in claim 5, in which polishing is carried out by means of a polishing surface, wherein the relative speed of the polishing surface relative to the main surface of the plate is so changed during the bulk-reduction cycle that a greater or smaller reduction is obtained at the edges of the main surface than in the central portion.

8. A method as claimed in claim 5, in which polishing is carried out by means of a polishing surface, wherein the force with which the polishing surface is pressed against the plate during the bulk-reduction cycle is varied, whereby a greater reduction at the edges than in the central portion is obtained at a comparatively low force and a smaller reduction at the edges than in the central portion is obtained at a comparatively high force.

9. A method of manufacturing a plate having a planar main surface through polishing of the main surface of the plate comprising:

polishing the main surface of the plate until the main surface has a convex initial shape and, performing a bulk-reduction cycle which comprises polishing the convex initial shape so that the main surface is given consecutively a substantially planar shape, a concave shape and again a substantially planar shape.

10. A method as claimed in claim 9, in which polishing is carried out by means of a polishing surface, wherein the shape of the polishing surface is changed during the bulk-reduction cycle so as to obtain a greater or smaller bulk reduction at the edges than in the central portion of the main surface.

11. A method as claimed in claim 9, in which polishing is carried out by means of a polishing surface, wherein the relative speed of the polishing surface relative to the main surface of the plate is so changed during the bulk-reduction cycle that a greater or smaller reduction is obtained at the edges of the main surface than in the central portion.

12. A method as claimed in claim 9, in which polishing is carried out by means of a polishing surface, wherein the force with which the polishing surface is pressed against the plate during the bulk-reduction cycle is varied, whereby a greater reduction at the edges than in the central portion is obtained at a comparatively low force and a smaller reduction at the edges than in the central portion is obtained at a comparatively high force.

13. A method of manufacturing a plate having parallel main surfaces through simultaneous polishing of the two main surfaces comprising:

polishing the main surfaces of a plate until these main surfaces have a concave initial shape, and performing a bulk-reduction cycle during which, in the case of a plate having edges which are thicker than a central portion surrounded by edges, the main surfaces are so polished that the edges are subsequently given a substantially equal thickness, a smaller thickness, and again a substantially equal thickness as compared with the central portion, and in the case of a plate having edges which are thinner than a central portion surrounded by edges, the main surfaces are so polished that the edges are given consecutively a substantially equal thickness, a thicker thickness, and again a substantially equal thickness as compared with the central portion.

14. A method as claimed in claim 13, in which polishing is carried out by means of a polishing surface, wherein the shape of the polishing surface is changed during the bulk-reduction cycle so as to obtain a greater or smaller bulk reduction at the edges than in the central portion of the main surface.

15. A method as claimed in claim 13 in which polishing is carried out by means of a polishing surface, wherein the relative speed of the polishing surface relative to the main surface of the plate is so changed during the bulk-reduction cycle that a greater or smaller reduction is obtained at the edges of the main surface than in the central portion.

16. A method as claimed in claim 13, in which polishing is carried out by means of a polishing surface, wherein the force with which the polishing surface is pressed against the plate during the bulk-reduction cycle is varied, whereby a greater reduction at the edges than in the central portion is obtained at a comparatively low force and a smaller reduction at the edges than in the central portion is obtained at a comparatively high force.

17. A method of manufacturing a plate having parallel main surfaces through simultaneous polishing of the two main surfaces comprising:

polishing the main surfaces of a plate until these main surfaces have a planar initial shape, and performing a bulk-reduction cycle during which, in the case of a plate having edges which are thicker than a central portion surrounded by edges, the main surfaces are so polished that the edges are subsequently given a substantially equal thickness, a smaller thickness, and again a substantially equal thickness as compared with the central portion, and in the case of a plate having edges which are thinner than a central portion surrounded by edges, the main surfaces are so polished that the edges are given consecutively a substantially equal thickness, a thicker thickness, and again a substantially equal thickness as compared with the central portion.

18. A method as claimed in claim 17, in which polishing is carried out by means of a polishing surface, wherein the shape of the polishing surface is changed during the bulk-reduction cycle so as to obtain a greater or smaller bulk reduction at the edges than in the central portion of the main surface.

19. A method as claimed in claim 17, in which polishing is carried out by means of a polishing surface, wherein the relative speed of the polishing surface relative to the main surface of the plate is so changed during the bulk-reduction cycle that a greater or smaller reduction is obtained at the edges of the main surface than in the central portion.

20. A method as claimed in claim 17, in which polishing is carried out by means of a polishing surface, wherein the force with which the polishing surface is pressed against the plate during the bulk-reduction cycle is varied, whereby a greater reduction at the edges than in the central portion is obtained at a comparatively low force and a smaller reduction at the edges than in the central portion is obtained at a comparatively high force.

21. A device for polishing a plate by rotatably contacting a main surface of the plate with a deformable polishing surface comprising:

a frame;

an annular carrier comprises a deformable carrier plate for carrying a polishing surface, in which one side of the annular carrier is attached directly to the frame and the opposite side of the annular carrier is connected to the carrier plate via an annular elastic hinge;

a chamber interposed between the annular carrier and the frame adapted to receive a pressurized fluid, whereby on pressurizing the chamber the hinged carrier plate can be deformed over its full width; and a pressurized fluid supply means for supplying the pressurized fluid to the chamber.

22. A device as claimed in claim 21, in which the annular carrier is provide with two support rings and the carrier plate is connected to each support ring by an annular elastic hinge.

23. A device as claimed in claim 22, in which the annular carrier is provided with a displaceable auxiliary ring, in which one side of the auxiliary ring is adjacent to the frame and the opposite side is connected to the carrier plate via an elastic hinge.

24. A device as claimed in claim 23, in which a measuring probe is fastened to the auxiliary ring for measuring the displacement of the auxiliary ring when the chamber is pressurized.

25. A device as claimed in claim 21, which rotatably contacts both main surfaces of the plate simultaneously.

26. A device for polishing a plate by rotatably contacting a main surface of the plate with a deformable polishing surface comprising:

a frame;

an annular carrier comprising with two support rings, a displaceable auxiliary ring and a deformable carrier plate for carrying a polishing surface, in which one side of each support ring is attached directly to the frame and the opposite side of each support ring is connected to the carrier plate via an annular elastic hinge, in which one side of the auxiliary ring is adjacent to the frame and the opposite side of the auxiliary ring is connected to the carrier plate via an annular elastic hinge, and in which the auxiliary ring is positioned between the two support rings;

a chamber interposed between the carrier and the frame adapted to receive a pressurized fluid, whereby on pressurizing the chamber the hinged carrier plate can be deformed over its full width; and a pressurized fluid supply means for supplying the pressurized fluid to the chamber.

27. A device as claimed in claim 26, in which the chamber further comprises a first compartment adjacent to the carrier plate between one of the support rings and the auxiliary ring, and connected through a channel to a second compartment adjacent to the carrier plate between the auxiliary ring and the other support ring.

28. A device as claimed in claim 26, in which a measuring probe is fastened to the auxiliary ring for measuring the displacement of the auxiliary ring when the chamber is pressurized.

29. A device as claimed in claim 26, which is duplicated on both sides of the plate and rotatably contacts both main surfaces of the plate simultaneously.

30. A device as claimed in claim 26, further comprising a feed device which penetrates the frame, the carrier and the polishing surface for delivering polishing agent between the surface of the plate and the polishing surface.

* * * * *